US010429142B1

(12) United States Patent
Rice

(10) Patent No.: US 10,429,142 B1
(45) Date of Patent: Oct. 1, 2019

(54) QUICK LOADER ASSEMBLY

(71) Applicant: Charles Rice, Mooresville, IN (US)

(72) Inventor: Charles Rice, Mooresville, IN (US)

( * ) Notice: Subject to any disclaimer, the term of this patent is extended or adjusted under 35 U.S.C. 154(b) by 0 days.

(21) Appl. No.: 16/026,838

(22) Filed: Jul. 3, 2018

(51) Int. Cl.
*F41A 9/83* (2006.01)
*F41A 9/72* (2006.01)

(52) U.S. Cl.
CPC . *F41A 9/83* (2013.01); *F41A 9/72* (2013.01)

(58) Field of Classification Search
CPC ..... F41A 9/72; F41A 9/83
See application file for complete search history.

(56) References Cited

U.S. PATENT DOCUMENTS 211,691 A * 1/1879 Bennett ..... F41A 9/83 42/87
391,811 A * 10/1888 Mixter ..... F41A 9/83 42/87
1,088,925 A 3/1914 Petersen
1,095,801 A 5/1914 Browning
2,456,159 A * 12/1948 Tratsch ..... F41A 9/72 124/45
2,472,678 A * 6/1949 Pickron ..... F41A 9/64 206/3
4,020,974 A * 5/1977 Bauer ..... B65D 83/0481 124/50
4,135,322 A * 1/1979 Tice ..... F41C 9/085 42/90
4,756,110 A * 7/1988 Beltron ..... F41A 9/83 42/87
4,831,998 A * 5/1989 Maguire, III ..... F41A 9/72 124/50
4,940,135 A * 7/1990 Hall ..... F41A 9/72 206/3
6,817,133 B1 11/2004 Williams
9,752,847 B2 9/2017 Steele
9,984,596 B2 * 5/2018 Kyogane ..... B29C 66/73921
2014/0230302 A1 8/2014 Crum et al.
2015/0362272 A1 12/2015 Dukes

* cited by examiner

*Primary Examiner* — Joshua T Semick

(57) ABSTRACT

A quick loader assembly for loading a breech loading or muzzle loading rifle includes a rifle that has a breech loader and the breech loader has an open end. A tube is include and a plurality of bullets is slidably positionable in the tube for loading the rifle. The tube is insertable into the open end of the breech loader thereby facilitating the bullets to be slid into the breech loader. A first cap is slidably positionable on the tube to close the tube thereby retaining the bullets within the tube.

3 Claims, 6 Drawing Sheets

QUICK LOADER ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to loader devices and more particularly pertains to a new loader device for loading a breech loading or muzzle loading rifle.

BRIEF SUMMARY OF THE INVENTION

An embodiment of the disclosure meets the needs presented above by generally comprising a rifle that has a breech loader and the breech loader has an open end. A tube is include and a plurality of bullets is slidably positionable in the tube for loading the rifle. The tube is insertable into the open end of the breech loader thereby facilitating the bullets to be slid into the breech loader. A first cap is slidably positionable on the tube to close the tube thereby retaining the bullets within the tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
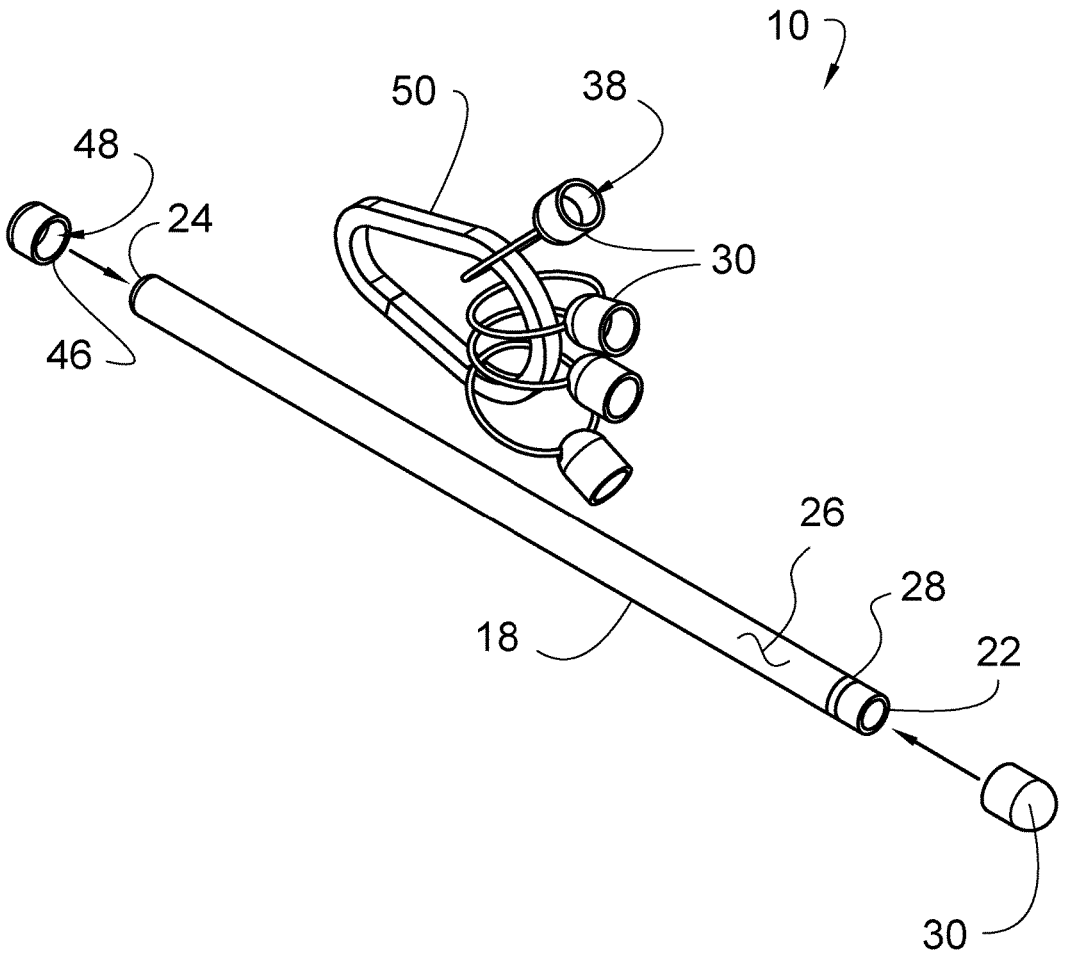
FIG. 1 is a perspective view of a quick loader assembly according to an embodiment of the disclosure.
Figure 2:
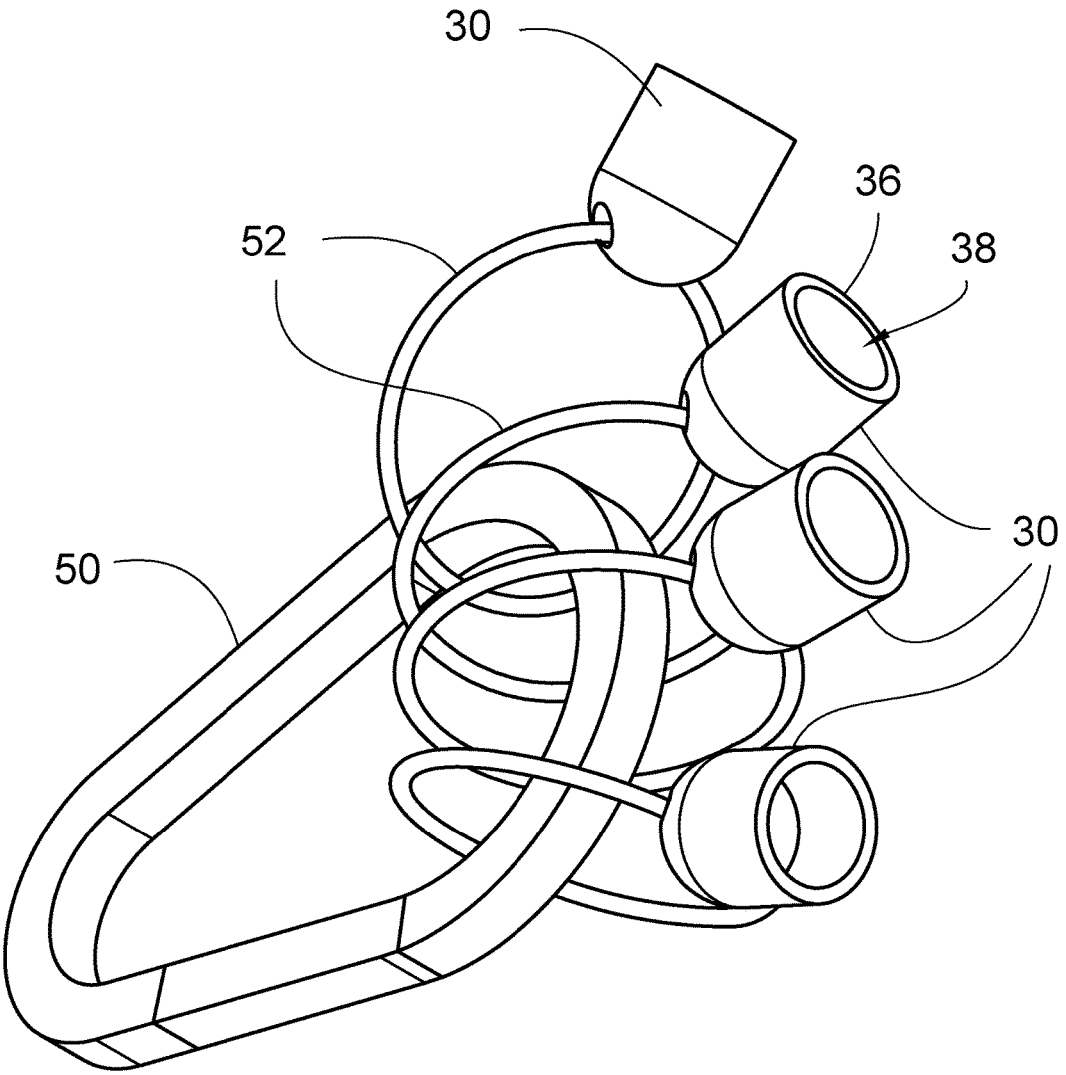
FIG. 2 is a perspective view of a clasp and a plurality of first caps of an embodiment of the disclosure.
Figure 3:
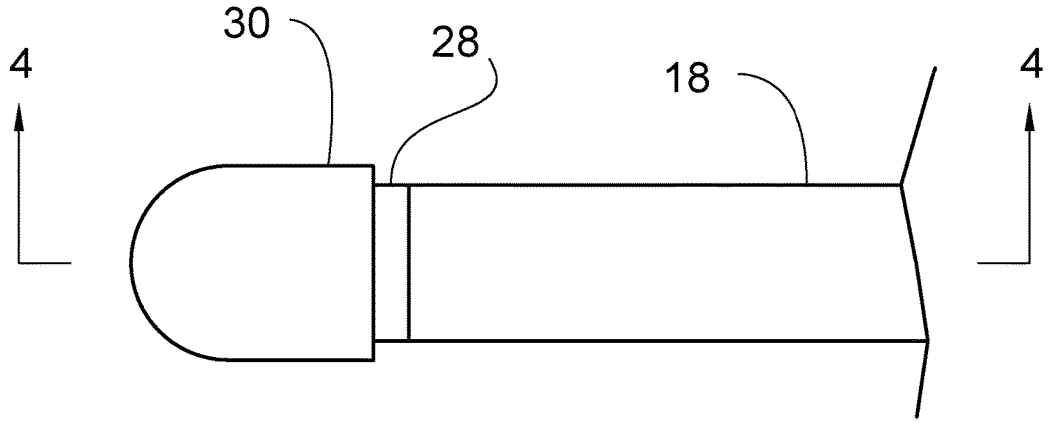
FIG. 3 is a right side view of first end of a tube of an embodiment of the disclosure.
Figure 4:
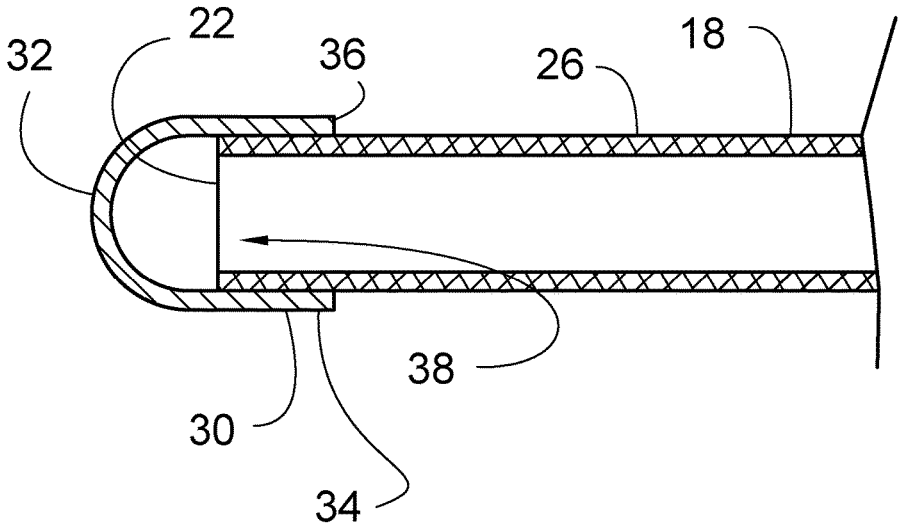
FIG. 4 is a cross sectional view taken along line 4-4 of FIG. 3 of an embodiment of the disclosure.
Figure 5:
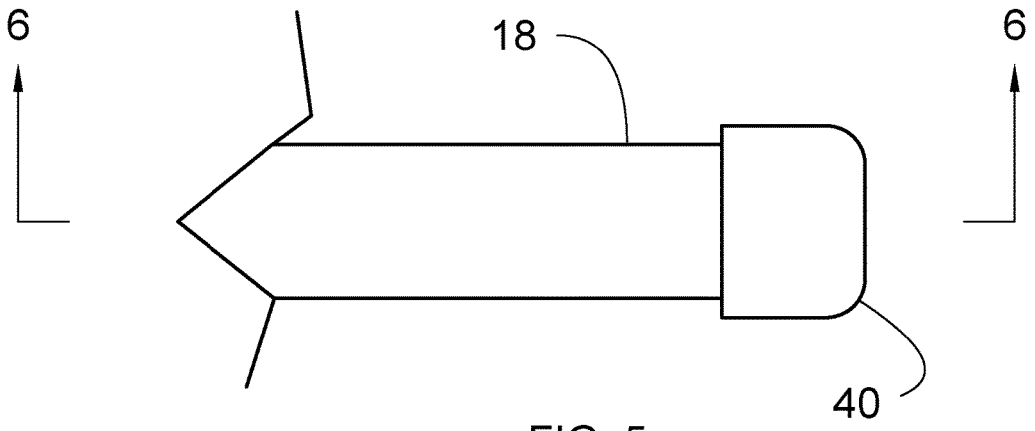
FIG. 5 is a right side view of second end of an embodiment of the disclosure.
Figure 6:
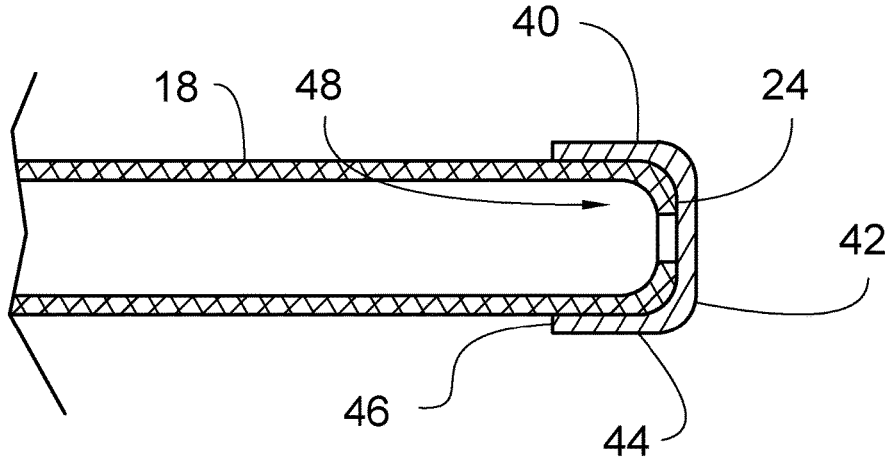
FIG. 6 is a cross sectional view taken along line 6-6 of FIG. 5 of an embodiment of the disclosure.
Figure 7:
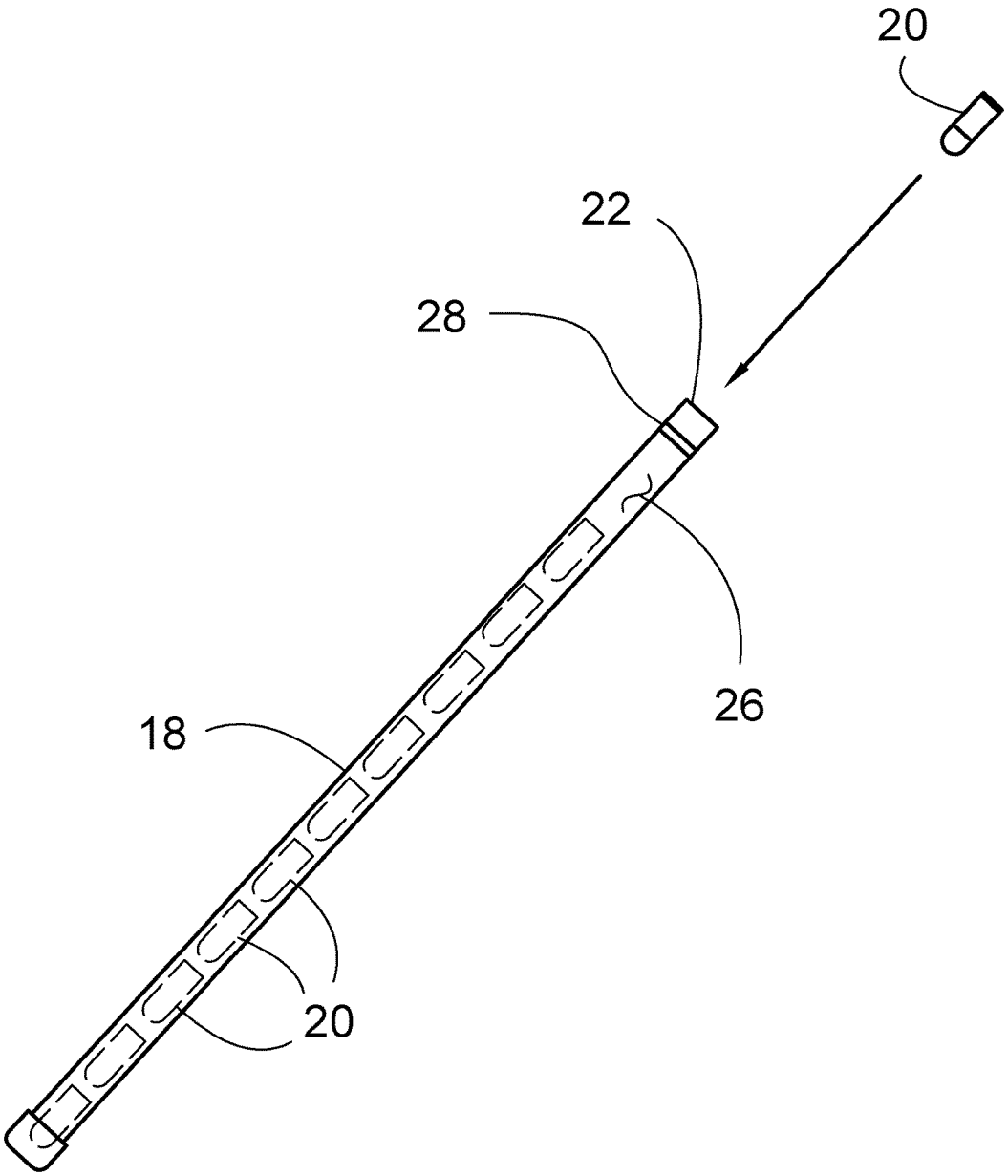
FIG. 7 is a perspective phantom view showing a bullet being inserted into a tube of an embodiment of the disclosure.
Figure 8:
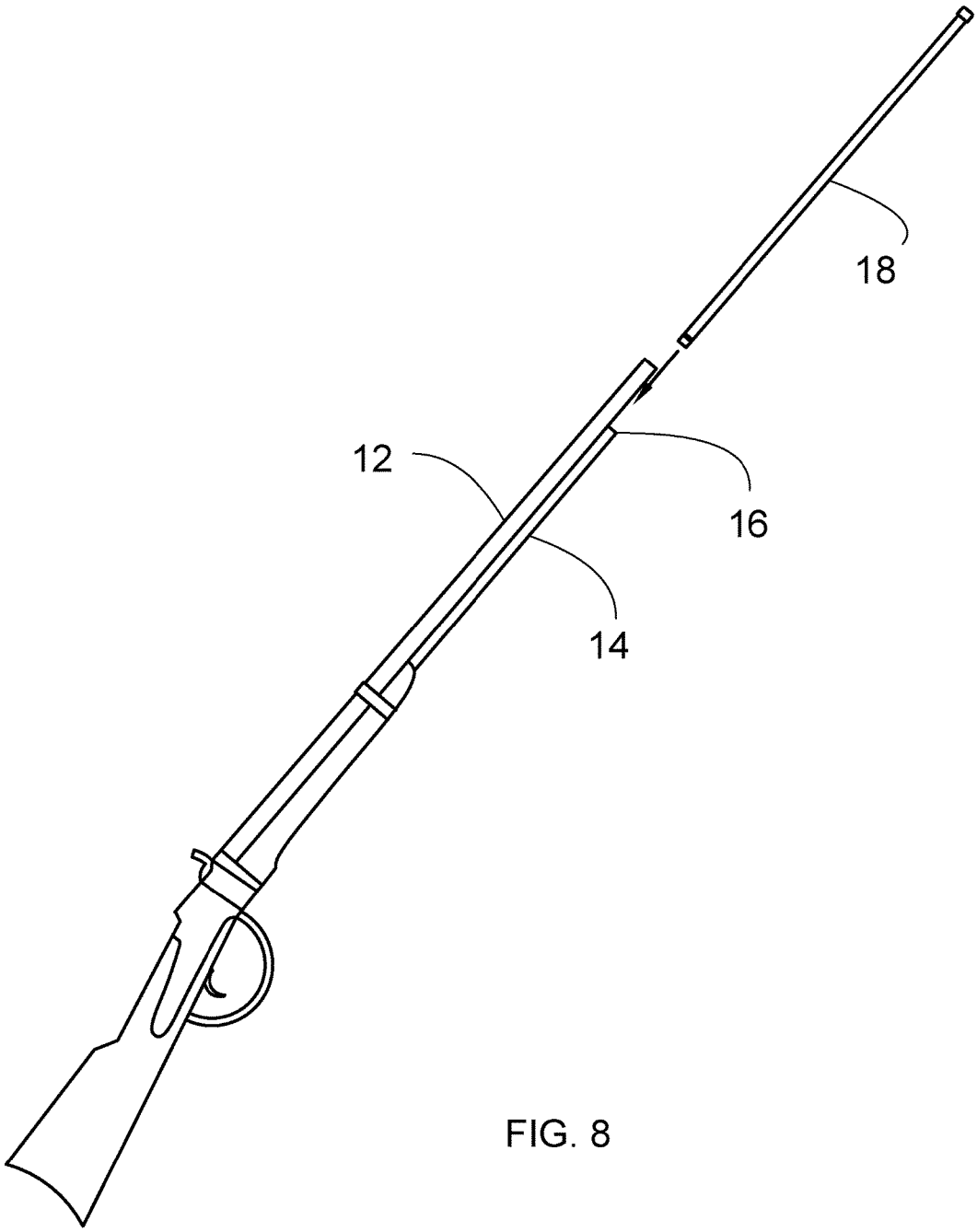
FIG. 8 is a perspective in-use view of an embodiment of the disclosure.

With reference now to the drawings, and in particular to FIGS. 1 through 8 thereof, a new loader device embodying the principles and concepts of an embodiment of the disclosure and generally designated by the reference numeral 10 will be described.

As best illustrated in FIGS. 1 through 8, the quick loader assembly 10 generally comprises a rifle 12 that has a breech loader 14 and the breech loader 14 has an open end 16. The rifle 12 may additionally be a muzzle loaded rifle. Moreover, the rifle 12 may be a rifle 12 of any conventional caliber, including but not being limited to, .22 caliber, .30 caliber and .50 caliber.

A tube 18 is provided and a plurality of bullets 20 is slidably positionable therein for loading the rifle 12. The bullets 20 may be rifle bullets of any conventional design and caliber. Additionally, the tube 18 has an inside diameter that corresponds to the caliber of the bullets 20. Thus, the bullets 20 do not rattle freely when the bullets 20 are positioned within the tube 18. The tube 18 is insertable into the open end 16 of the breech loader 14 thereby facilitating the bullets 20 to be slid into the breech loader 14. Alternatively, the tube 18 can be insertable into the muzzle of the muzzle loaded rifle 12.

The tube 18 has a first end 22, a second end 24 and an outer surface 26 extending therebetween, and the first end 22 insertably receives the bullets 20. The second end 24 is substantially closed thereby inhibiting the bullets 20 from passing therethrough. The outer surface 26 has a stripe 28 extending around an entire circumference of the tube 18 and the stripe 28 is spaced from the first end 22. The tube 18 may have a length ranging between approximately 35.0 cm and 50.0 cm.

A first cap 30 is slidably positionable on the tube 18 and the first cap 30 has a first wall 32 and an outer wall 34 extending away therefrom. The outer wall 34 is continuously arcuate and has a distal edge 36 with respect to the first wall 32 defining an opening 38 into the first cap 30. The opening 38 in the first cap 30 insertably receives the first end 22 of the tube 18 to close the first end 22 of the tube 18. In this way the bullets 20 are retained within the tube 18. The distal edge 36 is aligned with the stripe 28 when the first cap 30 is positioned on the tube 18 to inhibit the tube 18 from being inserted too far into the first cap 30. Moreover, the first cap 30 is removed from the first end 22 of the tube 18 thereby facilitating the bullets 20 to be released from the tube 18.

A second cap 40 is provided and the second cap 40 is slidably positionable on the tube 18. The second cap 40 has a primary wall 42 and an outside wall 44 extending away therefrom. The outside wall 44 is continuously arcuate having a distal edge 46 with respect to the outside wall 44 defining an opening 48 into the second cap 40. The opening 48 in the second cap 40 insertably receives the second end 24 of the tube 18 to close the second end 24 of the tube 18.

A clasp 50, such as a D-ring or the like, is provided and a plurality of the first caps 30 is provided. Each of the plurality of first caps 30 includes a ring 52 that is movably coupled thereto and the clasp 50 releasably engages the ring 52 on each of the first caps 30. A plurality of the tubes 18 is provided, and each of the tubes 18 may be loaded with the bullets 20. Moreover, each of the plurality of tubes 18 may be inserted into a respective one of the first caps 30 on the clasp 50. In this way a plurality of pre-loaded tubes 18 can be carried on a user for shooting competitions or other occasions when the rifle 12 may need to be quickly reloaded multiple times.

In use, the bullets 20 are inserted into the tube 18 unit the tube 18 is filled with the bullets 20. The first cap 30 is positioned on the first end 22 of the tube 18 and the second cap 40 is positioned on the second end 24 of the tube 18. Thus, the bullets 20 are retained within the tube 18. The rifle 12 is vertically oriented, the first cap 30 is removed from the first end 22 of the tube 18 and the first end 22 of the tube 18 is inserted into the open end 16 of the breech loader 14 or the muzzle, depending on the design of the rifle 12. Thus, the bullets 20 slide out of the tube 18 and into the rifle 12 to load the rifle 12. In this way the tube 18 inhibits the bullets 20 from being dropped, lost or accidentally discharged while the rifle 12 is being loaded.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A quick loader assembly being configured to load ammunition into a breech loading rifle, said assembly comprising:

a rifle having a breech loader, said breech loader having an open end;

a tube having a plurality of bullets being slidably positionable therein for loading said rifle, said tube being insertable into said open end of said breech loader thereby facilitating said bullets to be slid into said breech loader said tube having a first end, a second end and an outer surface extending therebetween, said first end insertably receiving said bullets, said second end being substantially closed thereby inhibiting said bullets from passing therethrough, said outer surface having a stripe extending around an entire circumference of said tube, said stripe being spaced from said first end; and a first cap being slidably positionable on said tube to close said tube thereby retaining said bullets within said tube, said first cap having a first wall and an outer wall extending from said first wall, said outer wall having a distal edge relative to said first wall, said distal edge aligning with said stripe when said first end of said tube is inserted into said first cap.

2. The assembly according to claim 1, further comprising a second cap being slidably positionable on said tube.

3. A quick loader assembly being configured to load ammunition into a breech loading rifle, said assembly comprising:

a rifle having a breech loader, said breech loader having an open end;

a tube having a plurality of bullets being slidably positionable therein for loading said rifle, said tube being insertable into said open end of said breech loader thereby facilitating said bullets to be slid into said breech loader, said tube having a first end, a second end and an outer surface extending therebetween, said first end insertably receiving said bullets, said second end being substantially closed thereby inhibiting said bullets from passing therethrough, said outer surface having a stripe extending around an entire circumference of said tube, said stripe being spaced from said first end;

a first cap being slidably positionable on said tube, said first cap having a first wall and an outer wall extending away therefrom, said outer wall being continuously arcuate and having a distal edge with respect to said first wall defining an opening into said first cap, said opening in said first cap insertably receiving said first end of said tube to close said first end of said tube thereby retaining said bullets within said tube, said distal edge being aligned with said stripe when said first cap is positioned on said tube, said first cap being removed from said first end of said tube thereby facilitating said bullets to be released from said tube; and a second cap being slidably positionable on said tube, said second cap having a primary wall and an outside wall extending away therefrom, said outside wall being continuously arcuate having a distal edge with respect to said outside wall defining an opening into said second cap, said opening in said second cap insertably receiving said second end of said tube to close said second end of said tube.

* * * * *